US005744689A

United States Patent [19]

Taguchi

[11] Patent Number: 5,744,689

[45] Date of Patent: Apr. 28, 1998

[54] TREATING MATERIAL FOR POLYCHLOROBIPHENYL-CONTAINING OILS

[75] Inventor: Yoshio Taguchi, Tokyo, Japan

[73] Assignee: Hiromi Taguchi, Tokyo, Japan

[21] Appl. No.: 738,477

[22] Filed: Oct. 28, 1996

[51] Int. Cl.[6] ..... A62D 3/00

[52] U.S. Cl. ..... 588/207; 588/205; 588/248; 588/901

[58] Field of Search ..... 588/205, 206, 588/208, 207, 213, 248, 901

[56] References Cited

U.S. PATENT DOCUMENTS

| | | | |
|---|---|---|---|
| Re. 31,267 | 6/1983 | Edgar et al. | 252/259.5 |
| 4,144,162 | 3/1979 | Edgar et al. | 252/259.5 |
| 4,554,002 | 11/1985 | Nicholson | 71/12 |
| 4,654,203 | 3/1987 | Mauer et al. | 588/209 |
| 4,855,083 | 8/1989 | Kagawa et al. | 588/213 |
| 5,037,286 | 8/1991 | Roberts | 23/313 R |
| 5,491,281 | 2/1996 | Bhat | 588/248 |

FOREIGN PATENT DOCUMENTS

| | | | |
|---|---|---|---|
| 4218281 | 9/1993 | Germany | 588/206 |
| 5-168727 | 7/1993 | Japan | 588/206 |

*Primary Examiner*—Gary P. Straub
*Attorney, Agent, or Firm*—Ladas & Parry

[57] ABSTRACT

The treating material for polychlorobiphenyl-containing oil comprises calcium oxide provided with a hydrophobic property by deposition of an oil and capable of taking place water absorbing exothermic reaction upon decomposition of the oil, sepiolite, vermiculite or zeolite as a porous material having an ion exchanging capability, capable of adsorbing the polychlorobiphenyl-containing oil and the hydrophobic calcium oxide and decomposing the oil, and potassium carbonate, sodium carbonate and neutral detergent as an oil decomposing agent for decomposing the oil deposited on calcium oxide. By mixing the treating material with polychlorobiphenyl-containing oil, the oil component is decomposed into a powder at a low temperature and chlorine is liberated from polychlorobiphenyl by the ion exchanging capability and changed to a nontoxic chlorine compound such as calcium chloride or magnesium chloride.

13 Claims, 5 Drawing Sheets

TREATING MATERIAL FOR POLYCHLOROBIPHENYL-CONTAINING OILS

BACKGROUND OF THE INVENTION

1. Field of the Invention

The present invention concerns a material for treating polychlorobiphenyl-containing oils used for detoxicating treatment of polychlorobiphenyl (PCB) used, for example, in electric insulation oils for transformers (transformer oils).

2. Description of the Related Art

Toxicity of polychlorobiphenyl, which is an organic chloride substance, has been known widely since polychlorobiphenyl used as a heat medium in heat exchangers leaked from pinholes formed in the heat exchangers and intruded into rice bran oils to bring about intoxication case by rice bran oils (case of Kanemi Oil Disease) in 1968.

Since polychlorobiphenyl is a stable halogen compound and organic halogen compounds are scarcely present in the natural world, microorganisms capable of disconnecting carbon-halogen bonds have not yet been found at present. Polychlorobiphenyl which is a stable halogen compound is absorbed by way of, for example, inhalers, digestive organs or skins, extremely stable in a living body, hardly dischargeable and oleo-soluble, and causes chronic intoxication when it is accumulated in fatty tissues, so that use of PCB is inhibited.

As a method of detoxicating polychlorobiphenyl used for transformer oils, studies have been made so far and successful results have been obtained to some extent. Since polychlorobiphenyl has a boiling point from 278° to 451° C. and is less volatilizing at a normal temperature, a method of burning at a high temperature (1400° C. or over) has been known as a general treating method.

Polychlorobiphenyl in transformer oils has covalent bonds, and is not soluble to water but highly soluble to an organic solvent, different from metal halides having ionic bonds. When such polychlorobiphenyl is burnt at a high temperature, since it changes to strongly toxic materials such as phosgene, dioxin and dioxirane at a low temperature of 600° C. or below during temperature elevation in the course of burning, which are discharged into air, high temperature heat treatment is difficult. As described above, regular practicalization with safety confirmation for detoxification of polychlorobiphenyl is a subject in the feature.

SUMMARY OF THE INVENTION

The present inventors, et al. have made various tests and studies in view of the foregoing situations and it is an object of the present invention to provide a treating material capable of detoxicating polychlorobiphenyl contained in oils by a simple method with no risk of forming strongly toxic materials such as phosgene, dioxin and dioxirane and capable of reducing the processing cost.

In accordance with the present invention, the foregoing object can be attained by a treating material comprising: calcium oxide provided with a hydrophobic property by deposition of oil and capable of taking place water absorbing exothermic reaction upon decomposition of the oil; a porous material having an ion exchange capability containing at least silicon dioxide and magnesium, capable of adsorbing polychlorobiphenyl-containing oil and hydrophobic calcium oxide to decompose the oil; and an oil decomposing agent for decomposing the polychlorobiphenyl-containing oil and the oil deposited on calcium oxide.

The porous material can be selected from sepiolite, vermiculite and zeolite. Potassium carbonate and sodium carbonate may be used for the oil decomposing agent and a neutral detergent may also be used in addition to potassium carbonate and sodium carbonate.

DESCRIPTION OF THE PREFERRED EMBODIMENTS

Figure 1:
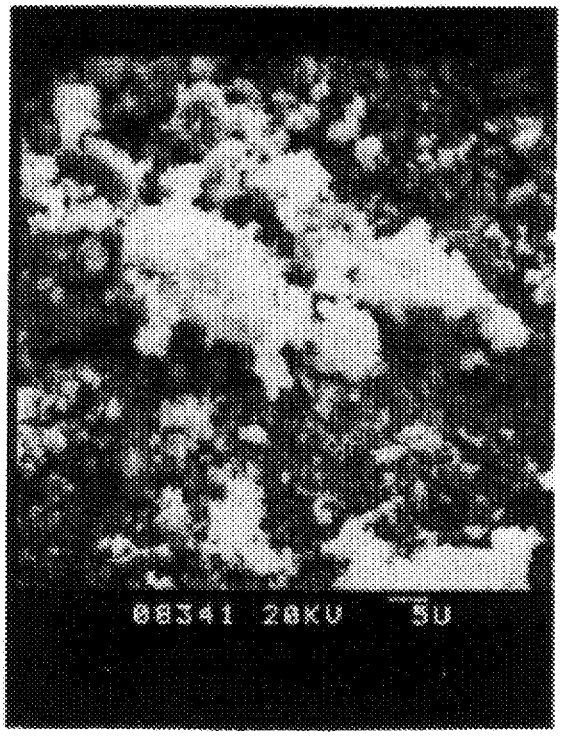
FIG. 1 is a photograph taken by an electron microscope for the surface of a powder sludge obtained by treating a spent transformer oil containing polychlorobiphenyl by using a treating material in Example 1 according to the present invention.

A preferred embodiment of the present invention is to be explained.

To 1 ton of calcium oxide, an oil is added by from 1 to 20 liters, preferably from 3 to 10 liters, and then mixed to obtain calcium oxide provided with a hydrophobic property by deposition of the oil. Then, to one liter of a polychlorobiphenyl-containing oil, for example, a transformer oil, were added 300 g to 2,000 g of calcium oxide provided with the hydrophobic property by the deposition of the oil, 50 g to 300 g of potassium carbonate, 40 to 250 g of sodium carbonate and sepiolite, vermiculite or zeolite as a porous material containing at least silicon dioxide and magnesium, preferably, one or both of sepiolite and vermiculite in an optional amount.

Polychlorobiphenyl is adsorbed together with an oil component to the porous material such as sepiolite or vermiculite, to lose its flowability and then brought into contact with calcium oxide which is similarly adsorbed to sepiolite or vermiculite and provided with the hydrophobic property by the deposition of the oil. For a predetermined period of time after contact, calcium oxide remains unreacted, being repelled from each other by the oil component. The oil component of the transformer oils and the oil component deposited to calcium oxide are gradually decomposed into carbon molecules and hydrogen molecules by the porous material such as sepiolite or vermiculite and potassium carbonate and sodium carbonate, by which ion exchange is started by hydrating reaction with sepiolite or vermiculite while causing gradual heat generation by calcium oxide, and chlorine in polychlorobiphenyl starts to liberate. Then, the oil component is decomposed as the temperature elevates to 80° C. to 100° C. at which hydrophobic calcium oxide changes to calcium hydroxide, to liberate chlorine in polychlorobiphenyl (if calcium oxide with no deposition of oil is used, since fine powder of calcium oxide is surrounded with no gaps by the oil component of the transformer oil, calcium oxide does not generate heat but remains unreacted). Liberated chlorine is adsorbed and replaced by ion exchanging performance, for example, of sepiolite or vermiculite. That is, liberated chlorine combines with calcium oxide, potassium carbonate, sodium carbonate, or magnesium contained in sepiolite or vermiculite and, further, other trace amount of ingredients contained in sepiolite or vermiculite by way of silicon dioxide contained in sepiolite, vermiculite or the like, and changes to a stable and nontoxic chlorine compound such as calcium chloride, potassium chloride, sodium chloride and magnesium chloride. On the other hand, the oil component decomposed by the oil decomposing agent described above is changed into powder by the elevation of the temperature due to heat generation of calcium oxide by the supply of water, coagulated and solidified with lapse of time and stabilized in an insoluble form.

As described above, although polychlorobiphenyl can be detoxicated by using only potassium carbonate or sodium carbonate as the oil decomposing agent, it takes 12 to 24 hours for the decomposition of the oil component and it may cause scattering in the decomposing reaction time. Then, when 10 cc to 50 cc of a neutral detergent diluted by five times by volume is added as the oil decomposing agent in addition to potassium carbonate and sodium carbonate, the oil component can be decomposed within about 30 min to 6 hours to cause exothermic reaction by calcium oxide under water supply to reduce the scattering.

As described above, polychlorobiphenyl-containing oils can be detoxicated by disconnecting carbon-halogen bonds at a low temperature and with no risk of generating highly toxic materials such as phosgene, dioxin and dioxirane, by a simple method of mixing, 30 to 200% of calcium oxide provided with the hydrophobic property, 5 to 30% of potassium carbonate, 4 to 25% of sodium carbonate and, optionally, 0.2 to 1% of a neutral detergent, each on the weight basis, and adding the mixture to the polychlorobiphenyl-containing oil.

In this case, if the oil component to calcium oxide is less than 0.1%, no hydrophobic property is provided to calcium oxide. If the oil is more than 2%, it is not decomposed by oil decomposition. If calcium oxide provided with the hydrophobic property is less than 30%, the amount of heat generation is insufficient and the oil component does not powder. On the other hand, if it is more than 200%, the treating effect increases no more but the treated amount is increased to increase the amount of wastes and requires higher cost. Potassium carbonate and sodium carbonate have a function of emulsifying or gelifying the oil component to facilitate powderization. Even if potassium carbonate is less than 5%, since the oil component does not emulsify or gelify, the oil component does not powder. If potassium carbonate is more than 30%, the treating effect increases no more but the treated amount is increased to increase the amount of wastes and require higher cost. In the same manner, if the amount of sodium carbonate is less than 4%, since the oil does not emulsify or gelify, the oil component can not be powdered. On the other hand, even if it is more than 25%, the treating effect increases no more but the treated amount is increased to increase the amount of the wastes and require higher cost. If the amount of the neutral detergent is less than 0.2%, decomposition of the oil component can not be promoted. On the other hand, even if the neutral detergent is more than 1%, the effect of promoting the decomposition of the oil is not changed but the treated amount is increased to increase the amount of wastes and require higher cost.

[EXAMPLE 1]

Vegetable oils were added by 3 liters to 1 ton of calcium oxide and mixed at a high speed to obtain calcium oxide, which was deposited with the vegetable oils and provided with a hydrophobic property. Sepiolite was used as a porous material and potassium carbonate and sodium carbonate were used as an oil decomposing agent. Hydrophobic calcium oxide, sepiolite, potassium carbonate and sodium carbonate were blended as below.

| | |
|---|---|
| Hydrophobic calcium oxide | 50 g |
| Sepiolite | 25 g |
| Potassium carbonate | 5 g |
| Sodium carbonate | 5 g |

The treating material mixed by the blending ratio described above were added by 85 g at a room temperature to 45 g of a spent transformer oil containing polychlorobiphenyl (2.4 ppm) and mixed slightly. As a result, a fine powder sludge was formed after lapse of about 3 hours.

The fine powder sludge 28 days after the treatment was analyzed according to KANSUIKAN (Ecological Water Quality Control) No. 127 (containment test method), and JIS K 0102-35.1 (leaching test method). As a result, the PCB content was 0.01 ppm or less and, after lapse of 90 days, it was 0.0005 ppm or less. It can be seen that the detoxicating treatment proceeded with lapse of time.

Figure 2:
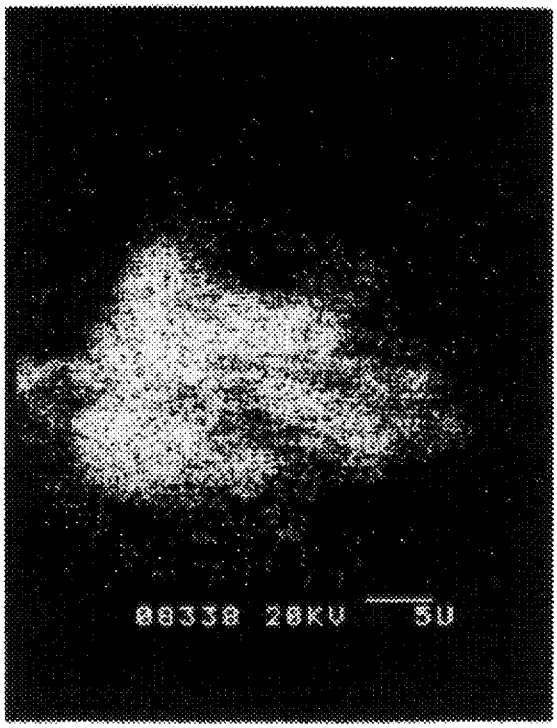
FIG. 2 is a photograph for silicon in the fine sludge taken by an X-ray microanalyzer.
Figure 3:
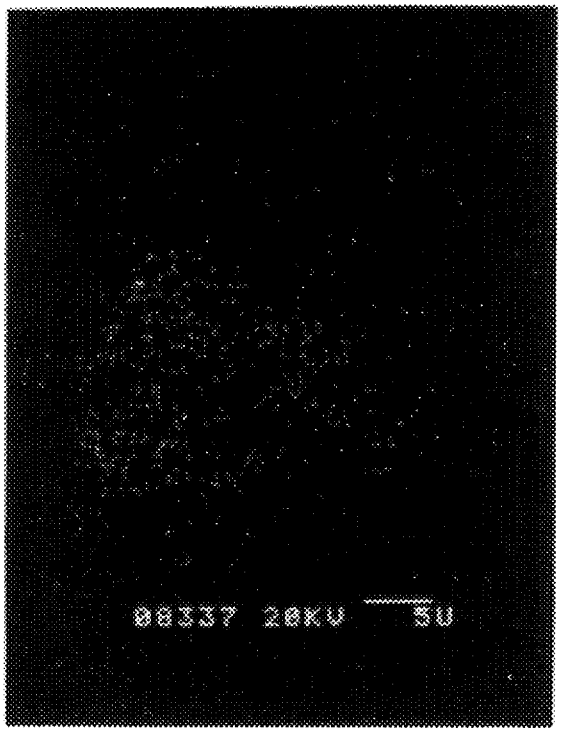
FIG. 3 is a photograph for chlorine in the fine sludge taken by an X-ray microanalyzer.
Figure 4:
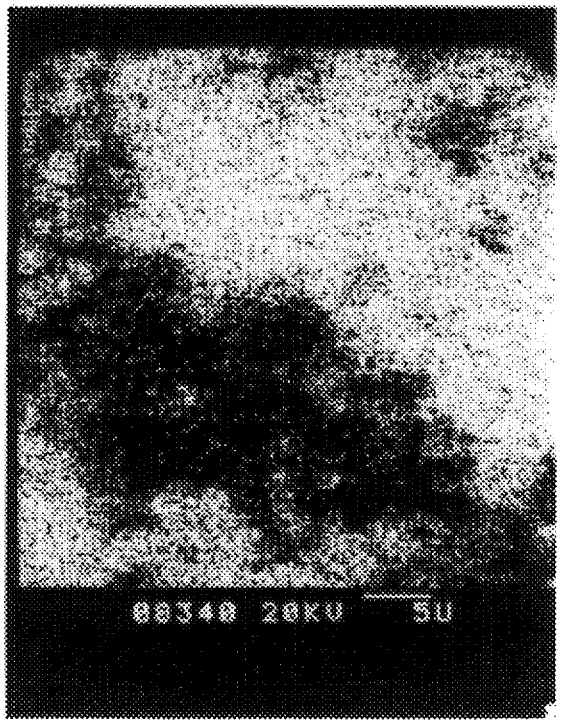
FIG. 4 is a photograph for calcium in the fine sludge taken by an X-ray microanalyzer.
Figure 5:
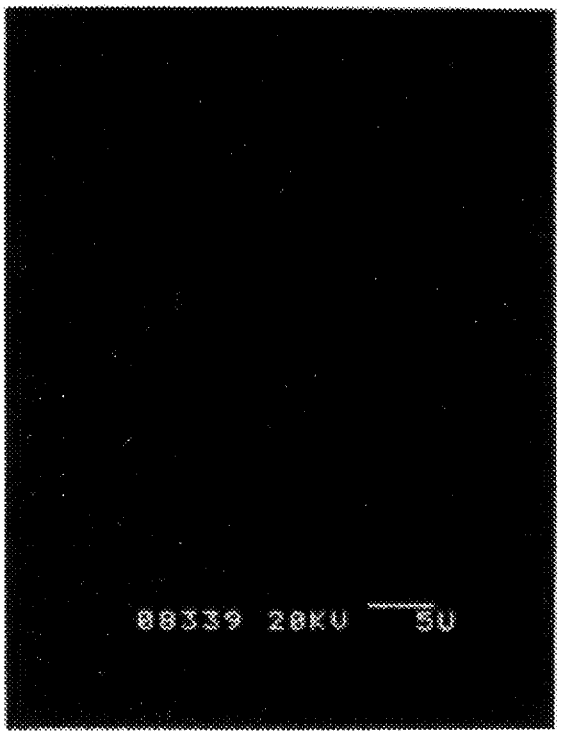
FIG. 5 is a photograph for magnesium in the fine sludge taken by an X-ray microanalyzer.

The surface state of the fine powder sludge 28 days after the lapse of the treatment by the treating material in Example 1 of the present invention was taken by an electron microscope. Silicon, chlorine, calcium and magnesium contained in the fine powder sludge were photographed by an X-ray microanalyzer at an identical position, and FIG. 1 to FIG. 5 respectively shows the photographs.

[EXAMPLE 2]

Hydrophobic calcium oxide obtained in the same manner as in Example 1, vermiculite as a porous material and potassium carbonate and sodium carbonate as an oil decomposing agent were blended as below.

| | |
|---|---|
| Hydrophobic calcium oxide | 50 g |
| Vermiculite | 25 g |
| Potassium carbonate | 5 g |
| Sodium carbonate | 5 g |

The treating material mixed by the blending ratio as described above were added in an amount of 85 g at a room temperature to 45 g of a spent transformer oil containing polychlorobiphenyl (2.4 ppm) and mixed slightly. As a result, a fine powder sludge was obtained with lapse of about 6 hours.

Then, the fine powder sludge after lapse of 28 days of the treatment described above was analyzed by the same test method as in Example 1. As a result, the PCB content was 0.1 ppm or less, which was further reduced to 0.0005 ppm or less after lapse of 90 days. It has been found that the detoxification proceeded with lapse of time.

Figure 6:
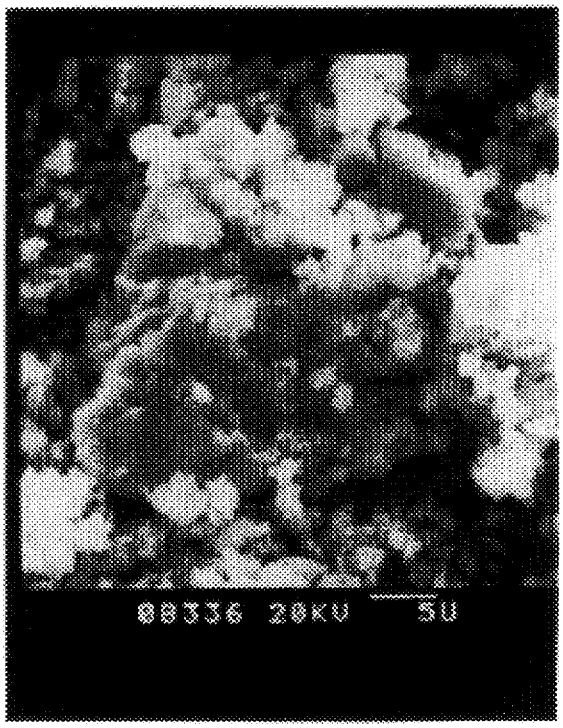
FIG. 6 is a photograph take by an electron microscope for the surface of a powder sludge obtained by treating a spent transformer oil containing polychlorobiphenyl by using a treating material in Example 2 according to the present invention.
Figure 7:
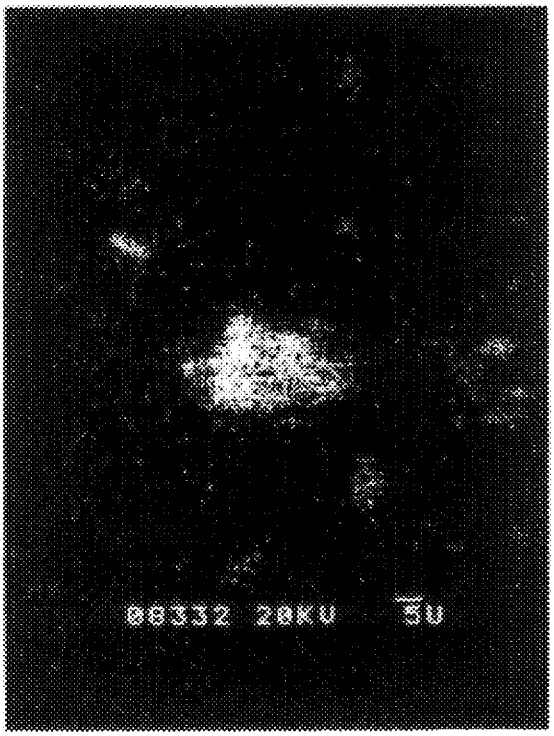
FIG. 7 is a photograph for silicon in the fine sludge taken by an X-ray microanalyzer.
Figure 8:
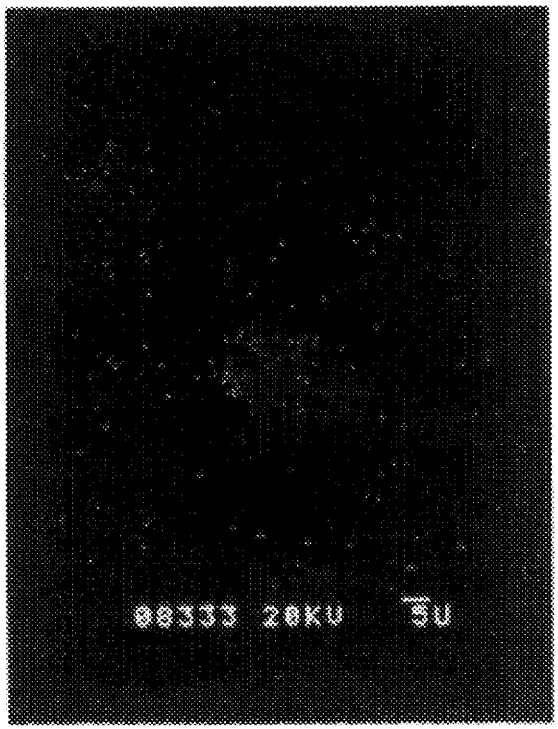
FIG. 8 is a photograph for chlorine in the fine sludge taken by an X-ray microanalyzer.
Figure 9:
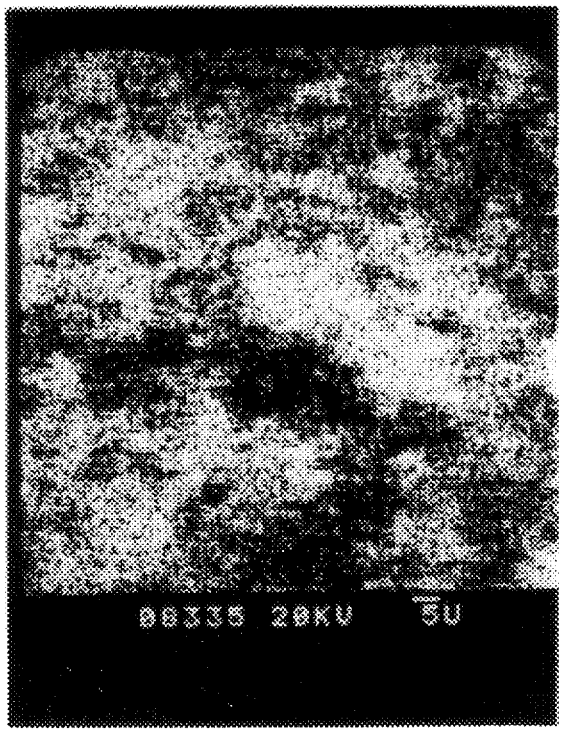
FIG. 9 is a photograph for calcium in the fine sludge taken by an X-ray microanalyzer.
Figure 10:
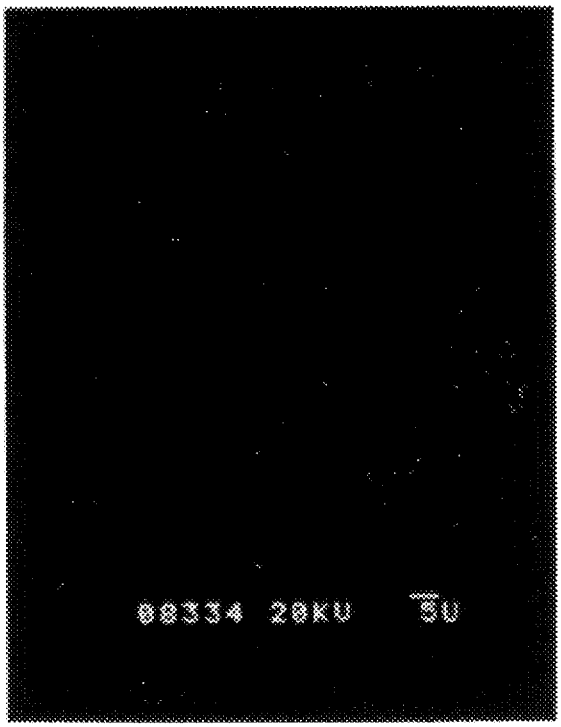
FIG. 10 is a photograph for magnesium in the fine sludge taken by an X-ray microanalyzer.

The surface state of the fine powder sludge 28 days after the treatment by the treating material of Example 2 of the present invention was taken by an electron microscope. Silicon, chlorine, calcium and magnesium contained in the fine powder sludge were taken at an identical position by an X-ray microanalyzer and the photographs are shown in FIG. 6 to FIG. 10, respectively.

[EXAMPLE 3]

Hydrophobic calcium oxide obtained in the same manner as in Example 1, sepiolite as a porous material and potassium carbonate and sodium carbonate as an oil decomposing agent were blended as below.

| | |
|---|---|
| Hydrophobic calcium oxide | 50 g |
| Vermiculite | 25 g |
| Potassium carbonate | 5 g |
| Sodium carbonate | 5 g |

The treating material mixed by the blending ratio as described above were added in an amount of 85 g at a room temperature to 45 g of 70% original solution of spent transformer oil containing polychlorobiphenyl adjusted with trimethyl pentane (5 ppm) and mixed slightly. As a result, a fine powder sludge was obtained after about 6 hours.

Then, the fine powder sludge after lapse of 28 days of the treatment described above was analyzed by the same test method as in Example 1. As a result, the PCB content was 0.1 ppm or less, which was further reduced to 0.0005 ppm or less after lapse of 90 days, and it has been found that the detoxification proceeded with lapse of time.

[EXAMPLE 4]

A treating material mixed at a blending ratio in Example 1 was added to 45 g of a spent transformer oil (12.56 ppm) containing polychlorobiphenyl at a room temperature and mixed slightly, except for using 25 cc of a neutral detergent diluted by five times by volume as an oil decomposing agent and mixed slightly. As a result, a fine powder sludge was obtained after lapse of about 20 min.

As a result of analysis for the fine powder sludge after lapse of 17 days by the treatment described above, the PCB content was 1.42 ppm, which was further reduced to 0.0005 ppm or less after the lapse of 90 days and it has been found that the detoxicating treatment proceeded with lapse of time.

[EXAMPLE 5]

Hydrophobic calcium oxide obtained in the same manner as in Example 1, sepiolite as a porous material, and potassium carbonate, sodium carbonate and a neutral detergent as an oil decomposing agent were blended as below.

| | |
|---|---|
| Hydrophobic calcium oxide | 1000 g |
| Sepiolite | 500 g |
| Potassium carbonate | 15 g |
| Sodium carbonate | 14 g |
| Neutral detergent | 5 g |

The treating material mixed with the blending ratio as described above were added at a room temperature of about 15° C. to one liter of a spent transformer oil containing polychlorobiphenyl and mixed slightly. As a result, the temperature was elevated to about 80° C. for about 15 min and to 90° C. for about 20 min, in which adsorbing/substituting reactions were started. On the contrary, as a comparison, the same treating material as described above with the same blending ratio, except for not using the neutral detergent, was added at a room temperature of about 15° C. to one liter of a spent transformer oil containing polychlorobiphenyl and mixed slightly. As a result, the temperature was elevated to 80° C. for about 2 hours and to 90° C. for about 3 hours, in which adsorbing/substituting reactions were started.

As a result of analysis by the same test method as in Example 1, in any of fine powder sludges 28 days after the treatment, the PCB content was 0.1 ppm or less, which was further reduced to 0.0005 ppm or less after the lapse of 90 days. It has been found that the detoxication proceeded with lapse of time. From the result, it has been found that the initiation time for the exothermic decomposing reaction (80° C. to 100° C.) and the completion time (about 30° C. or less) can be promoted while the result of the detoxification was similar by using the neutral detergent as the oil decomposing agent compared with the case of not using the same.

In summary, according to the present invention, polychlorobiphenyl-containing oils can be detoxicated safely with no risk of generating highly toxic materials such as phosgene and dioxin and at a reduced cost by decomposing the oil component at a low temperature and liberating chlorine of polychlorobiphenyl and changing it into a non-toxic chlorine compound by ion exchanging capability, by a simple method of using calcium oxide provided with a hydrophobic property by deposition of the oil, and capable of taking place water absorbing exothermic reaction by decomposition of the oils, a porous material having an ion exchanging capability containing at least silicon dioxide and magnesium and capable of adsorbing the polychlorobiphenyl-containing oil and the hydrophobic calcium oxide and decomposing the oil, and an oil decomposing agent for decomposing the oil containing polychlorobiphenyl and the oil deposited to calcium oxide and adding the treating materials to the polychlorobiphenyl-containing oil.

What is claimed is:

1. A process for treating a polychlorobiphenyl-containing oil comprising contacting the polychlorobiphenyl-containing oil with a composition having components as follows:

i) calcium oxide having deposited thereon an oil that renders the calcium oxide hydrophobic;

ii) a decomposing agent for dehalogenating the polychlorobiphenyl-containing oil;

iii) a porous material, containing at least silicon dioxide and magnesium, for absorbing the polychlorobiphenyl-containing oil, said porous material having ion exchange capability, said porous material containing water in an amount sufficient to initiate an exothermic reaction with the calcium oxide to elevate the temperature of a mixture resulting from contacting the polychlorobiphenyl-containing oil with the composition;

said components being present in the composition in respective amounts and said contacting being effected for a time sufficient to cause (a) dehalogenation of the polychlorobiphenyl-containing oil with the concomitant formation of carbon atoms and hydrogen atoms; (b) initiation of said exothermic reaction resulting in an exchange of ions; and (c) formation of the mixture into a powder sludge.

2. A process as defined in claim 1, wherein the porous material is selected from the group consisting of sepiolite, vermiculite and zeolite.

3. A process as defined in claim 2, wherein the decomposing agent comprises potassium carbonate and sodium carbonate.

4. A process as defined in claim 3, wherein the components are present in the mixture in an amount by weight based on the polychlorobiphenyl-containing oil as follows: hydrophobic calcium oxide from 30 to 200%, potassium carbonate from 5 to 30% and sodium carbonate from 4 to 25%.

5. A process as defined in claim 4, wherein the deposited oil is present in the mixture in an amount of from 0.1 to 2% by weight ratio based on the calcium oxide.

6. A process as defined in claim 2, wherein the decomposing agent comprises potassium carbonate, sodium carbonate and a neutral detergent.

7. A process as defined in claim 6, wherein the components are present in the mixture in an amount by weight based on the polychlorobiphenyl-containing oil as follows: hydrophobic calcium oxide from 30 to 200%, potassium carbonate from 5 to 30%, sodium carbonate from 4 to 25% and the neutral detergent from 0.2 to 1%.

8. A process as defined in claim 7, wherein the deposited oil is present in the mixture in an amount of from 0.1 to 2% by weight ratio based on the calcium oxide.

9. A process as defined in claim 1, wherein the decomposing agent comprises potassium carbonate and sodium carbonate.

10. A process as defined in claim 9, wherein the components are present in the mixture in an amount by weight based on the polychlorobiphenyl-containing oil as follows: hydrophobic calcium oxide from 30 to 200%, potassium carbonate from 5 to 30% and sodium carbonate from 4 to 25%.

11. A process as defined in claim 10 wherein the deposited oil is present in the mixture an amount of from 0.1 to 2% by weight ratio based on the calcium oxide.

12. A process as defined in claim 1, wherein the decomposing agent comprises potassium carbonate, sodium carbonate and a neutral detergent.

13. A process as defined in claim 12, wherein the components are present in the mixture in an amount by weight based on the polychlorobiphenyl-containing oil as follows: hydrophobic calcium oxide from 30 to 200%, potassium carbonate from 5 to 30% and sodium carbonate from 4 to 25% and a neutral detergent from 0.2 to 1%.

* * * * *